US006077810A

United States Patent [19]

Imaeda

[11] Patent Number: 6,077,810

[45] Date of Patent: Jun. 20, 2000

[54] IMAGING SYSTEM

[75] Inventor: Mikio Imaeda, Bisai, Japan

[73] Assignee: Brother Kogyo Kabushiki Kaisha, Nagoya, Japan

[21] Appl. No.: 09/401,842

[22] Filed: Sep. 22, 1999

[30] Foreign Application Priority Data

Sep. 30, 1998 [JP] Japan ..... 10-278570

[51] Int. Cl.[7] ..... B41M 5/20; G03D 15/00

[52] U.S. Cl. ..... 503/201; 430/138; 430/348; 430/350; 430/353

[58] Field of Search ..... 503/201; 430/138

[56] References Cited

U.S. PATENT DOCUMENTS 4,399,209 8/1983 Sander et al. ..... 430/138
4,440,846 4/1984 Sanders et al. ..... 430/138
5,246,811 9/1993 Higuchi ..... 430/138
5,948,586 9/1999 Hare ..... 430/138

*Primary Examiner*—Hoa Van Le
*Attorney, Agent, or Firm*—Oliff & Berridge, PLC

[57] ABSTRACT

An imaging system is provided wherein images are formed with good tonal qualities in a short time immediately after development process. Concretely, the imaging system of the invention comprises a print medium, wherein microcapsules encapsulate a color-forming material, a polymerization initiator and a developer, an irradiation box, which selectively exposes the print medium, a pressure-developing roller, and first and second post heaters. After the development using the pressure-developing roller, the print medium is heated by the first post heater on the condition that the heating time Y is longer than a second and shorter than approximately 1060 exp (−0.082X) seconds, wherein X is defined as the heating temperature (degrees). Further, the print medium is heated by the second post heater on the condition that the heating time Y is shorter than a second and longer than approximately 1060 exp (−0.082X) seconds.

26 Claims, 5 Drawing Sheets

Fig.4

| ELAPSED TIME AFTER OUTPUTTING IMAGES | ① WITHOUT THERMAL FIXING | ② 170°C × 7msec/mm | ③ 40°C × 30s 170°C × 7ms/mm | ④ 24°C × 60s 170°C × 7ms/mm | ⑤ 24°C × 60s 120°C × 67ms/mm | ⑥ 24°C × 10s 120°C × 67ms/mm |
|---|---|---|---|---|---|---|
| 15 sec | 0.67 | 1.53 | 1.77 | 1.68 | 1.84 | 1.71 |
| 30 sec | 0.77 | 1.55 | 1.77 | 1.69 | | |
| 1 min. | 0.91 | 1.56 | 1.77 | 1.71 | | |
| 3 min. | 1.20 | 1.58 | 1.77 | 1.73 | | |
| 5 min. | 1.33 | 1.61 | 1.78 | 1.72 | | |
| 10 min. | 1.51 | 1.66 | 1.79 | 1.75 | | |
| 1 hours | 1.84 | 1.78 | 1.80 | 1.83 | | |
| 3 hours | 1.91 | 1.83 | 1.82 | | | |
| 6 hours | 1.94 | 1.84 | 1.82 | | | |
| 24 hours | 1.95 | 1.86 | 1.82 | 1.87 | 1.88 | 1.73 |

IMAGING SYSTEM

BACKGROUND OF THE INVENTION

1. Field of Invention

The invention relates to an imaging system which forms an image by exposing microcapsules that encapsulate a photosensitive material, thereby, creating a latent image with the capsules of various mechanical strength, and rupturing the capsules with pressure, so that the image is developed on a print medium. More concretely, the invention relates to the imaging system wherein the method of heating using a heating unit for promoting an image-forming reaction is improved.

2. Description of Related Art

There have been proposed imaging systems based on microcapsules, as disclosed in U.S. Pat. No. 4,440,846 and U.S. Pat. No. 4,399,209.

Such imaging systems form an image by selectively exposing a photosensitive layer, wherein a photosensitive material is encapsulated within microcapsules, to radiation in correspondence with image information, and then, rupturing the capsules with pressure, whereby the photosensitive material flows out so as to produce the image. The mechanical strength of the microcapsules is changed by exposure so that a latent image is formed with the capsules. The capsules that have not been cured or have been plasticized by radiation are ruptured with pressure due to their weak mechanical strength, and release a color-forming material (a color former) therefrom. The color-forming reaction occurs between the color-forming material and a developer, which produces a color image.

A light and pressure sensitive print medium is utilized for the above-described imaging system. The light and pressure sensitive print medium has a layer structure of a sheet-shaped first substrate, a light and pressure sensitive layer which covers the first substrate with the mixture of the microcapsules and the developer, and a sheet-shaped second substrate. This print medium is easy to handle, because a desired image is formed thereon by exposure. The image is formed on the exposed print medium by the color-forming reaction, which gradually occurs between the color-forming material and the developer after a pressure-developing process. Ordinarily, it takes at least about an hour to obtain an acceptable image by this chemical reaction, and takes nearly 24 hours to complete the color-forming reaction so as to form the image with good tonal qualities. For example, the optical density of the image formed on the light and pressure sensitive print medium is initially less than 0.7 in black, and goes up to more than 1.9 after 24 hours, when left behind at room temperature.

Therefore, contrary to the other types of imaging systems that do not make use of the light and pressure sensitive print medium, it is not possible to estimate or use the image immediately after the development, because of its low optical density (which is less than 0.7 as mentioned above). Also, since the initial image is tinged with red, it is necessary to spend a long time to fix the color tone before use and estimation of the image.

In order to solve the above-mentioned problem, there has been proposed a method by which the print medium is heated, for example, at 80 to 90 degrees in order to promote the color-forming reaction. The imaging system using this method has already been manufactured, providing the higher initial density of the image immediately after the development.

However, this method still has a problem concerning the optical density. The optical density of the image is not high enough for practical use after 24 hours, thereby, providing a monotonous pattern. Furthermore, the optical density does not increase more than a fixed value, even if the print medium is heated at a higher temperature than 80 to 90 degrees. The color-forming material is transformed as a result of promoting the color-forming reaction at such a high temperature, and loses the ability to form a desired color. Accordingly, the optical density of the image does not increase enough to form a satisfactory image with this method, although the practical density can be obtained without the heating process as time passes by.

SUMMARY OF THE INVENTION

The invention has been developed to solve the problem mentioned above by providing an imaging system based on microcapsules comprising a color-forming material therein, in which a practical image is formed with good tonal qualities immediately after the development process.

One specific embodiment of the invention relates to an imaging system that includes microcapsules that encapsulate a color-forming material and changes mechanical strength by exposure to the light having a certain wavelength, a photosensitive print medium, wherein a latent image is formed by exposing the capsules, an irradiation unit to selectively emit the light having a certain wavelength to the print medium, a pressure-developing unit to rupture the capsules having weak mechanical strength with pressure in correspondence with the latent image, so that the encapsulated color-forming material flows out so as to form an image, and a heating unit that heats so as to promote a color-forming reaction.

In accordance with one embodiment of the invention, heating by the heating unit is divided into pluralities of steps. Each step has a different purpose, thereby bringing a different effect, such as heating that does not cause the color-forming material to transform, or heating that increases the optical density of the image in a short time. The image is immediately and efficiently formed with good tonal qualities using the heating unit.

Preferably, the steps performed by the heating unit in the imaging system of the invention include: a first heating step, wherein the color-forming material is heated without causing its transformation, and a second heating step, wherein the material is heated at a higher temperature after the first heating step.

With this arrangement, the color-forming reaction can be efficiently promoted by the first heating step without the transformation of the color-forming material. This first heating step is characterized by its heating time Y, which is shorter than 1063.1 exp (−0.0822X) seconds and longer than a second wherein X is defined as a heating temperature (degrees). Further, the image can certainly obtain a high optical density in a short time by the second heating step in which the print medium is heated at a higher temperature. The second heating step is also characterized by its heating time Y, which is longer than 1063.1 exp (−0.0822X) seconds wherein X is defined as a heating temperature (degrees). In order to prevent overheating in the second heating step, the second heating time may be shorter than a second.

The imaging system of the invention, comprising the above-described heating unit, can certainly raise the optical density to a practical value in a short time, thereby, providing the image with good tonal qualities immediately after the development process.

BRIEF DESCRIPTION OF THE DRAWINGS

A preferred embodiment of the invention will be described in detail with reference to the following drawings wherein:

FIG. 4 is the list of experimental values that are used for drawing FIG. 3.

DETAILED DESCRIPTION OF PREFERRED EMBODIMENTS

Figure 1:
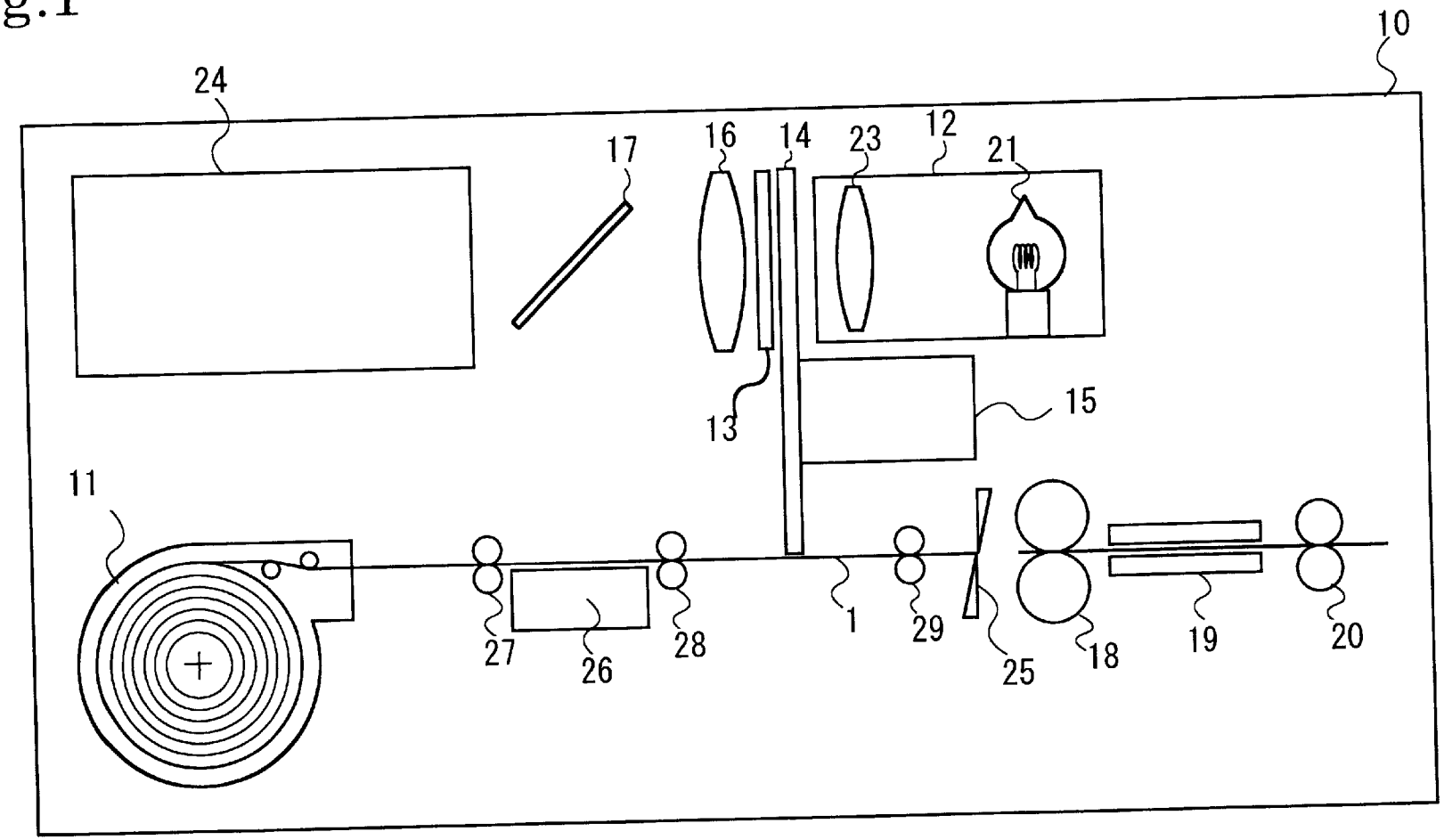
FIG. 1 schematically shows a cross section of a light and pressure sensitive printer, which is an imaging system to expose and develop a light and pressure sensitive print medium.

Hereinafter, an explanation will be given of an imaging system in accordance with the invention referring to the drawings.

FIG. 1 schematically shows a sectional view of a light and pressure sensitive printer 10 as an imaging system, which exposes a light and pressure sensitive print medium 1 and develops an image thereon.

As shown in FIG. 1, a cassette 11 made of a light-shielding material is loaded within the light and pressure sensitive printer 10 so as to be attached to and removed from the printer 10. The cassette 11 stores the light and pressure sensitive print medium 1 that has not been exposed. The roll-shaped print medium 1 is wound with a transparent substrate 2 (described below) on the outside thereof, and drawn out toward an exposure stage 26.

A feed roller 27 is provided between the cassette 11 and the exposure stage 26, a feed roller 28 is also provided facing to the feed roller 27 across the exposure stage 26. A feed roller 29 is further provided between the feed roller 28 and a cutter 25. Each of the feed rollers 27, 28 and 29 consists of a pair of rollers in which one roller follows the other, thereby, moving in association with each other. Controlled by a control unit 24 and driven with a drive motor (not shown), the feed rollers 27, 28 transport the print medium 1 in the transport direction (which is toward the right-hand side of FIG. 1). When the cassette 11 is placed in a predetermined position of the printer 10, the print medium 1 is supported with the feed rollers 27, 28 and 29, and drawn out from the cassette 11 by fixed length with the feed rollers 27 and 28.

Then, the print medium 1 is transported to an exposure position on the exposure stage 26.

An irradiation box 12 comprises a lamp 21 formed of a halogen lamp as a light source, and a condenser lens 23 therein. The condenser lens 23 converges the light from lamp 21 so that the light penetrates a filter plate 14. The filter plate 14 has three colors (red, blue and green) of filters therein, and is rotated by a motor 15. A liquid crystal shutter 13 filled up with a liquid crystal plate (not shown) is arranged after the filter plate 14, and controlled by the control unit 24 so as to selectively penetrate or block the light from the irradiation box 12. An imaging lens 26, which is fit into a holder member (not shown), is also arranged after the liquid crystal shutter 13, and converges the light that has penetrated the shutter 13. The light that has passed through the imaging lens 26 further goes to a mirror 17. The mirror 17 is slanted 45 degrees against the optical axis so that the optical path is bent toward the exposure stage 26.

The exposure stage 26 is provided between the feed rollers 27 and 28, and opposite to the irradiation box 12. The optical path bent by the mirror 17 extends to the exposure position on the exposure stage 26.

The print medium 1 is transported to the exposure stage 26, and then, exposed to the light from the lamp 21 that has been filtered by the filter plate 14 and has penetrated the liquid crystal shutter 13 so as to form an image thereon.

A cutter 25 is arranged on the downstream side of the feed roller 29, and a pressure-developing roller 18 is further arranged after the cutter 25, as shown in FIG. 1.

A pressure-developing roller 18 formed of a pair of rollers presses the surface of the print medium 1 to rupture microcapsules of weak mechanical strength. (As described below, the microcapsules that have not been exposed have weak mechanical strength, since a radiation curable resin is encapsulated therein.) Thus, the encapsulated material (colorless dye precursor) flows out from the capsules, and reacts with a developer, whereby the image is colored and visible. The pressure on the print medium 1 applied during the pressure-developing process has to be high enough to rupture the microcapsules of weak mechanical strength, but should not be so high as to rupture the capsules that are exposed by radiation (not decreased in mechanical strength). The microcapsules are pressed with pressure of $10^6$ kg/mm$^2$ in the present embodiment.

The first post heater 19 is provided after the pressure-developing roller 18 comprising a pair of heating plates opposed to each other, and covers the whole print medium in width. The second post heater 20 is also provided next to the first post heater 19 and comprises a pair of cylindrical heating rollers in which one roller follows the other.

Ceramic heaters are preferably applied to both of the first and the second post heater. Further, nichrome wire may be used as a heating element. Still further, the second post heater 20 may comprise a halogen lamp (not shown) therein as a heating element.

The second post heater 20 also serves as a transport roller. The print medium 1 is cut by a fixed length with the cutter 25 after an image is formed thereon. Then, the print medium 1 is discharged by the second post heater 20 out of the printer 10.

Inputted image data is revised as necessity requires, and developed into print data by an arithmetic portion and a control portion in the control unit 24. These arithmetic control portions are formed of CPU, ROM and RAM (not shown). Based on this print data, signals are transmitted to a liquid crystal shutter drive (not shown), thereby, driving the liquid crystal shutter 14 in order to expose images.

Figure 2:
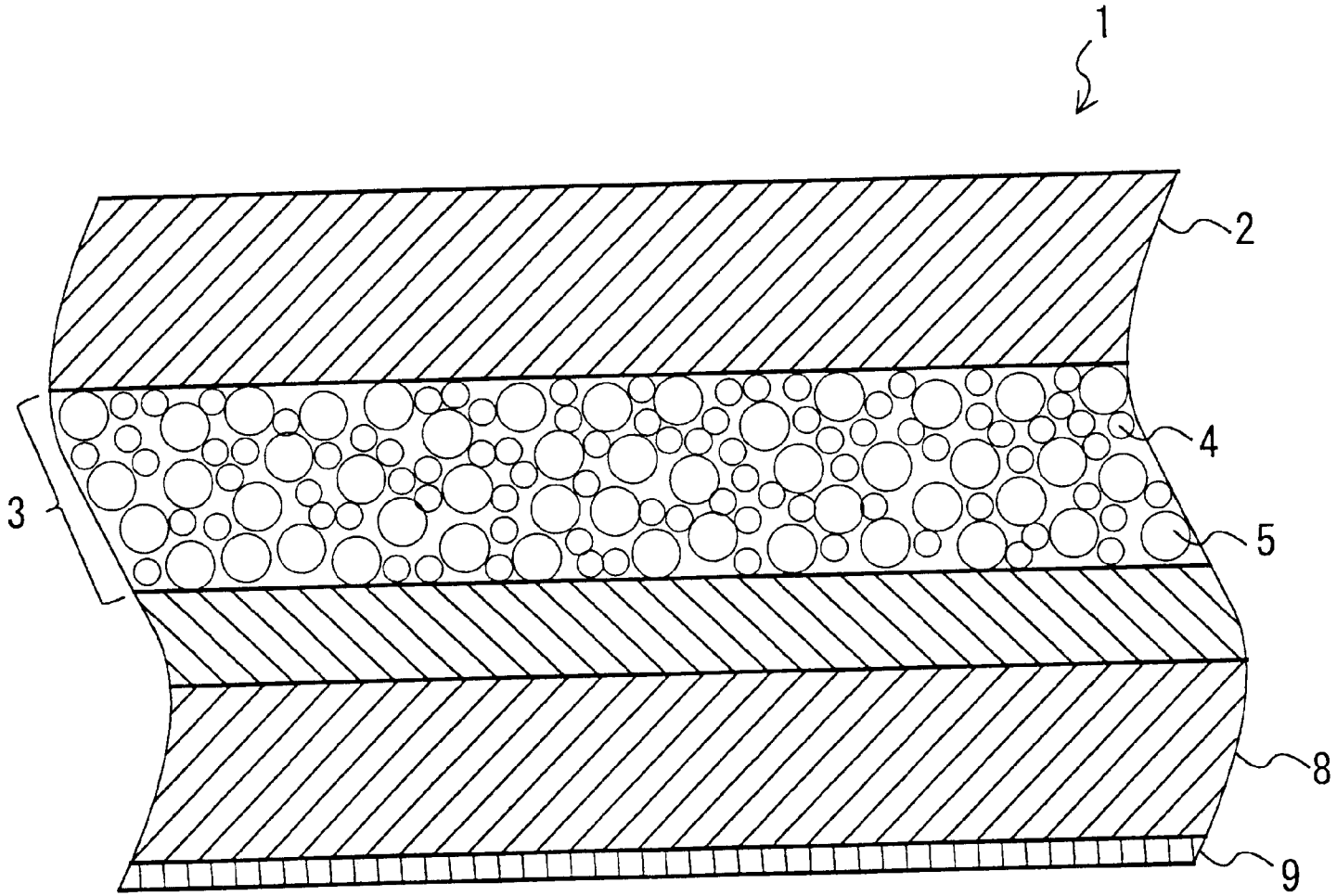
FIG. 2 is a schematic illustration of a cross-section of the light and pressure sensitive print medium.

Next, the structure of the light and pressure sensitive print medium 1 will be explained with reference to FIG. 2, which schematically shows its sectional structure. As shown in FIG. 2, a transparent substrate 2 is laminated above a light and pressure sensitive layer 3 that is coated with the mixture of microcapsules 4 and a co-reactant 5 (a developer). The microcapsules 4 encapsulate a dye precursor (as a color-forming material) which reacts with the co-reactant 5 to be bright in colors, and a radiation curable resin which increases its mechanical strength by exposure to the light having a certain wavelength. Further, a sheet-shaped substrate 8 is laminated beneath the light and pressure sensitive layer 3 with a writable sheet 9 thereunder.

The substrate 2 is preferably made of a resin film, such as polyethylene terephthalate (PET), polyethylene naphthalate (PEN) and polyphenylene sulfide (PPS), which is transparent and has appropriate rigidity and tensile strength.

The substrate 8 preferably has opacity so that images can be clearly observed even if outputted images are put on the dark-colored background. Thereby, the substrate 8 is made of a paper, a synthetic paper, or a resin film, such as PET, PEN, and PPS, that contains a white pigment, such as titanium oxide and zinc oxide. The substrate 8 may be made of a transparent or opaque film coated with a layer of a white pigment, such as titanium oxide and zinc oxide, so that the substrate 8 is bright in white.

There are provided three types of microcapsules 4, and each of them encapsulates: a dye precursor, which is transparent and colors in yellow, magenta or cyan; a radiation curable resin, which is exposed to each light of primary colors; and a polymerization initiator.

For example, in the case of exposing the print medium 1 to blue-light (having a wavelength of about 470 nm), only the microcapsules 4 comprising a yellow dye precursor are cured by radiation, thereby, not being ruptured with pressure. On the other hand, the microcapsules 4 comprising magenta and cyan dye precursors are not cured, thereby, being ruptured with pressure. These magenta and cyan dye precursors flow out and react with the developer, whereby the each dye colors in magenta or cyan, and mixed into blue. As a result, the blue is observed through the substrate 2. In the same way, in the case of exposing the print medium 1 to green-light (having a wavelength of about 525 nm), only the microcapsules 4 comprising a magenta dye precursor are cured by radiation. As the microcapsules 4 comprising yellow and cyan dye precursors are not cured, these capsules are ruptured with pressure, whereby dye precursors flow out and react with the developer. The each dye respectively colors in yellow or cyan, and mixed into green, which is observed through the substrate 2. Furthermore, in the case of exposing the print medium 1 to red-light (having a wavelength of about 650 nm), only the microcapsules 4 comprising a cyan dye precursor are cured by radiation. The uncured microcapsules 4, which comprise yellow and magenta dye precursors in this case, are ruptured with pressure, whereby these dye precursors react with the developer. The each dye respectively colors in yellow or magenta, and mixed into red. Accordingly, this red is observed through the substrate 2.

When all of the microcapsules 4 are exposed and cured, any color is not observed, since the microcapsules 4 are not ruptured with pressure. Consequently, the surface of the substrate 8 (which is white) turns into visible through the substrate 2, and provides white background.

Color images are formed only on the part where the color-forming reaction occurs. This color-forming principle is referred to as self-coloring. The surface of the substrate 2 is also referred to as a coloring surface.

The well-known microcapsules can be applied to the embodiment of the invention. The following components are encapsulated within the microcapsules by the wall made of a polymer (such as gelatin, polyvinyl alcohol and polyisocyanate):

- a color precursor, which is, for example, triphenylmethane dye or spiropyran dye;
- a radiation curable resin having a acryloyl group, such as trimethylolpropane triacrylate; and
- a photoinitiator, such as benzophenone and benzoylalkylether.

Similarly, the following well-known developers can be used as the co-reactant 5:

- acidic materials, for example, inorganic oxide (such as acid clay, kaolin, acid zinc, and titanium oxide) or phenol-novolac resin; or
- organic acid.

This co-reactant 5 should be determined concerning the composition of the color precursor within the microcapsules 4.

Binder, filler, and viscosity regulator are added to the mixture of the 20 microcapsules 4 and the co-reactant 5, and which is applied to the substrate 2 with a roller, a spray or a blade.

Now, the workings of the printer 10 will be described with reference to FIG. 1.

First, a user sets the cassette 11 to the printer 10, and switches the printer 10 on. Next, a printing start signal is input with image data (RBG data), and sent to the printer 10 from a host computer, which is connected to the printer 10.

A controller (not shown) comprising the control unit 24 draws out the print medium 1 by a fixed length from the cassette 11 by rotating the feed rollers 27 and 28 in correspondence with the printing start signal. The fixed length of the print medium 1 is transported with the feed rollers 27 and 28 to the exposure stage 26 that is located beneath the mirror 17.

Then, the image data that will color in red is displayed on a liquid crystal plate (not shown). Also, the filter plate 14 is rotated by the motor 15, thereby, arranging a red filter so as to cross the light path. When the lamp 21 in the irradiation box 12 is turned on, red images are formed on the print medium 1 located at the exposure position through the imaging lens 16.

Similarly, the image data that will color in green is displayed on the liquid crystal plate. The filter plate 14 is rotated by the motor 15, and then, a green filter is arranged so as to cross the light path. Green images are formed on the print medium I through the imaging lens 16, when the lamp 21 is turned on.

Furthermore, the image data that will color in blue is displayed on the liquid crystal plate. A blue filter is arranged to cross the light path by rotating the filter plate 14 by the motor 15. Then, blue images are formed on the print medium 1 through the imaging lens 16, when the lamp 21 is turned on.

The print medium 1 which has been exposed to each light, is transported with the feed roller and cut by a fixed length with the cutter 25. After that, the microcapsules 4 that have not cured by radiation are ruptured with pressure, thereby, causing the color-forming reaction.

After the pressure-development, the print medium 1 is heated with the first post-heater 19 at 40 degrees for 30 seconds, then, heated again with the second post-heater 20 at 170 degrees. The images are settled on the print medium 1 by completing the color-forming reaction between the dye precursor and the co-reactant 5. Finally, the print medium 1 is discharged out of the printer 10.

While the example above shows the print medium 1 being heated with the first post-heater 19 at 40 degrees, then, heated again with the second post-heater 20 at 170 degrees, the first post heater 19 may preferably apply heat the print medium in the range of between 30°–70° C., and in a second heating step, may preferably apply heat to the print medium in the range of between 85°–180° C.

Now, the effect of heating the print medium 1 in two steps will be explained by giving examples. This effect is obtained when using the typical print medium having a structure shown in FIG. 2.

Figure 3:
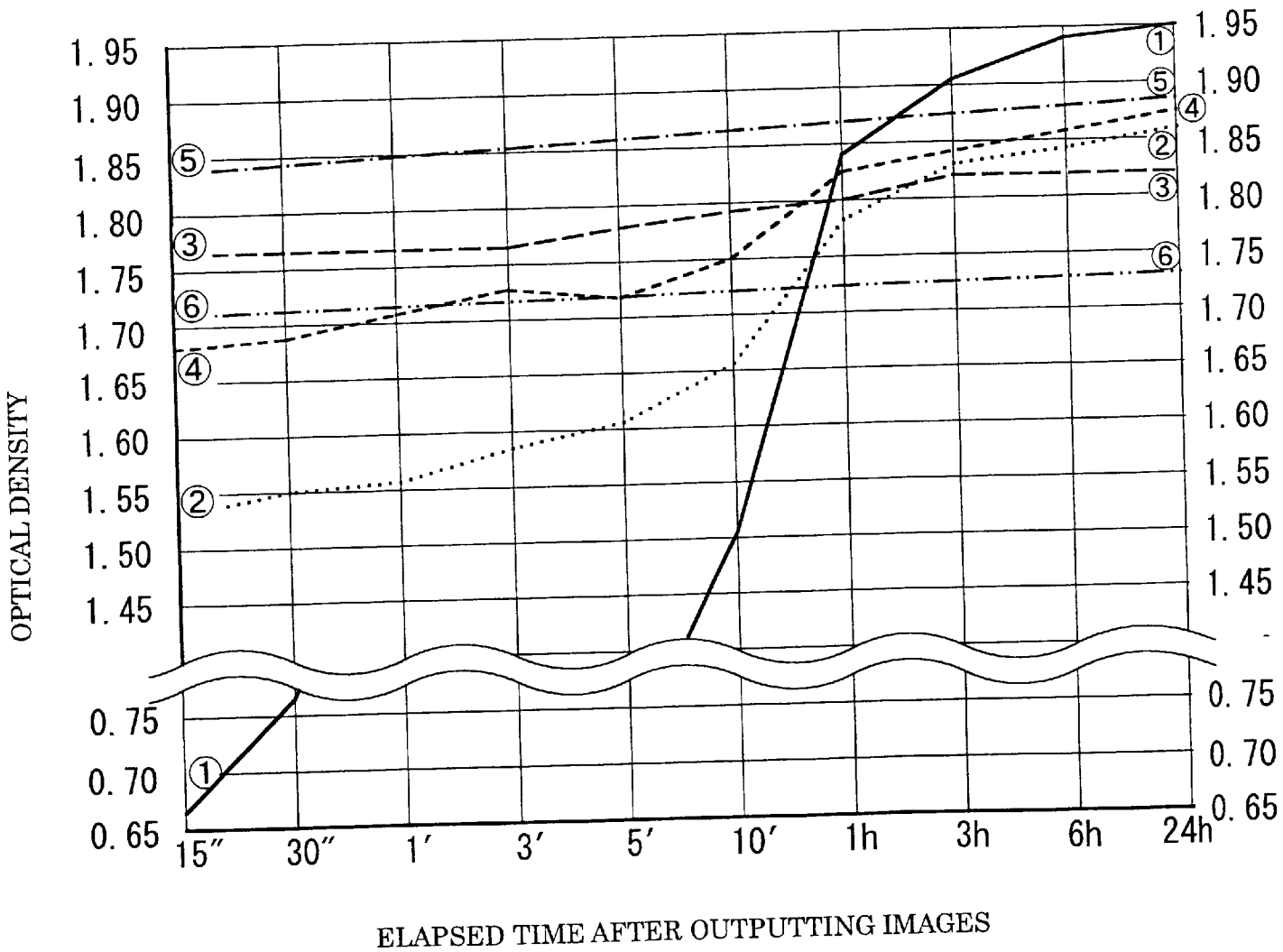
FIG. 3 shows the change in the optical density of images for 24 hours, which are formed on the light and pressure sensitive print medium by pressure-development without exposure.

FIG. 3 shows the change in the optical density of images for 24 hours formed on the print medium 1 in the pressure-developing process without exposure. FIG. 4 is the list of experimental values that are used for FIG. 3. Herein, the vertical and horizontal axis in FIG. 3 respectively shows the optical density of images and the elapsed time after outputting the images. The unit "ms/mm" in FIG. 4 refers to the time (ms) that is spent to heat 1 mm of the print medium 1. The values of the optical density (especially, of black) are normalized by filtering through the luminosity filter, as the luminosity factor differs depending on the wavelength of light.

As shown in FIGS. 3 and 4, the optical density of the output image is initially 0.67 (15 seconds after the output) in the case of not heating the print medium 1. Then, the image gradually increases in optical density, which goes up from 0.67 to 1.95 for 24 hours.

In the case of heating the print medium 1 at 170 degrees, at a speed of 7 ms/mm, the image increases in optical density from 1.53 to 1.86 for 24 hours.

Examining various combinations of the heating temperature and the heating time as shown in FIGS. 3 and 4, the effect of heating can be concluded as described below. When heating the print medium 1 with large amount of energy (in other words, at a higher temperature), images do not increase in optical density so much as time passes, thereby, not providing a high density after 24 hours, although the initial density is comparatively high. On the other hand, when heating the print medium 1 with a small amount of energy, the optical density goes up to a high value for 24 hours in spite of its low initial density. However, the condition that leads to a high initial density can not be obtained by heating the print medium 1 in one step.

In the case of heating the print medium 1 at 40 degrees for 30 seconds, and then, at 170 degrees at a speed of 7 ms/mm, the optical density of the image goes up from 1.77 to 1.82 during 24 hours. The optical density relatively stays same for 24 hours in this case, although the final density is a little lower than one that is not heated. Further, the initial density is 0.2 higher than one heated in one step (at 170 degrees, at a speed of 7 ms/mm), and the final density is nearly the same.

The above-described experimental results leads to the conclusion that it is effective to heat the print medium 1 in two steps (with a small amount of energy in the first heating step, and then, with a large amount of energy in the second heating step) in order to secure high optical density.

The performance of the imaging system is generally estimated by the image immediately after output. Thus, it is desirable to obtain a high initial density at the time when the image is output, if there is little difference in the optical density for 24 hours.

Figure 5:
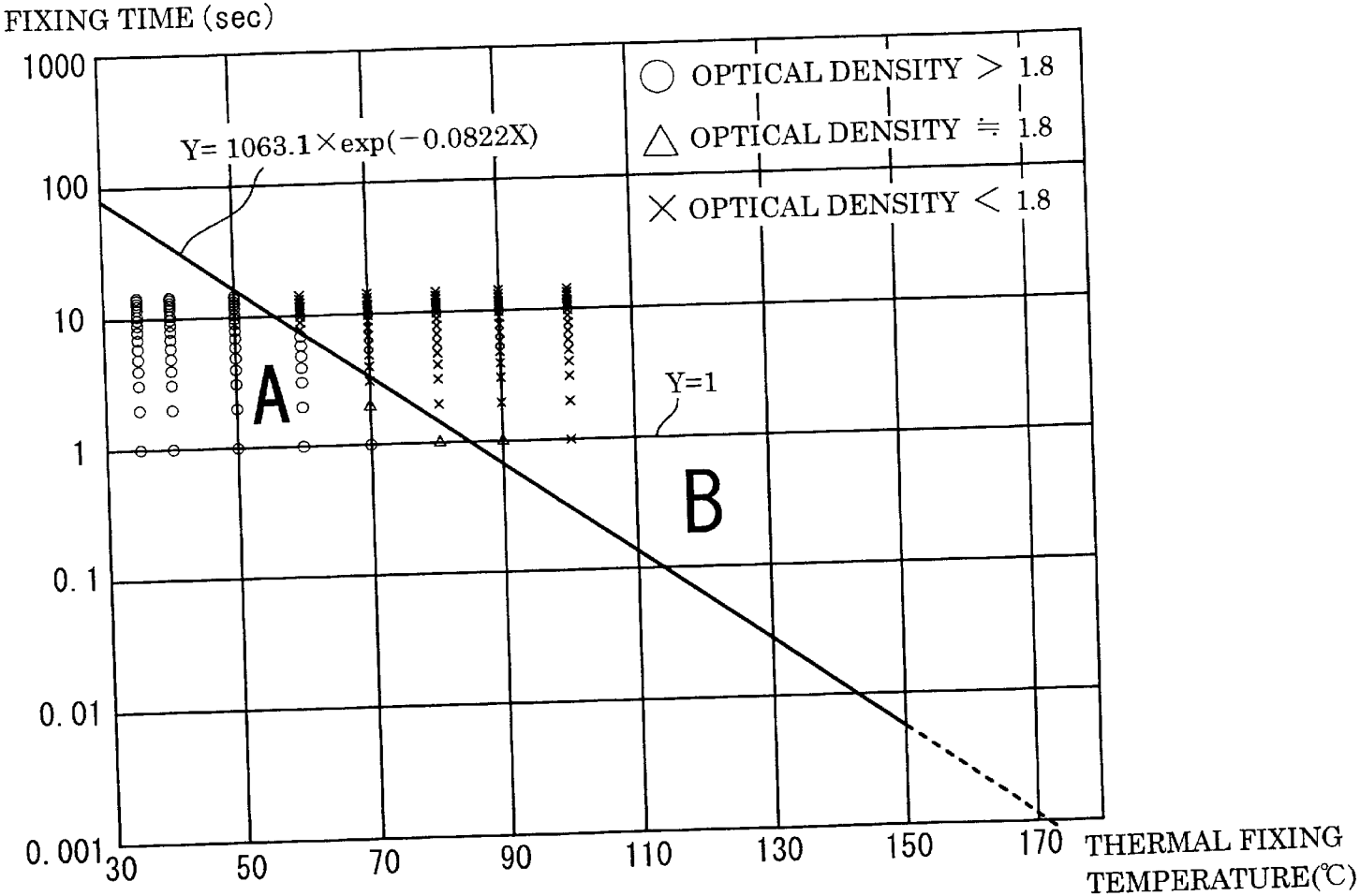
FIG. 5 shows the suitable heating temperature and time of a heating unit, which are defined by various experiments.

Based on the facts mentioned above, various heating conditions are examined in order to define the appropriate range for each of the first and the second heating steps. FIG. 5 is based on the experimental values obtained in the examined heating conditions. The vertical axis shows the thermal fixing time (heating time) in seconds in logarithms, and the horizontal axis shows the thermal fixing temperature (heating temperature) by degree. In the experiments, the optical density is measured after the pressure-developing process without exposure. Herein, the practical optical density is defined 1.8 after 24 hours. The obtained density over 1.8 is plotted in FIG. 5 with "O". In the same way, the density below 1.8, and the density about 1.8 are respectively plotted in FIG. 5 with "Δ" and "X", respectively.

Based on the obtained experimental values, the boundary line of the heating condition, wherein the practical optical density is obtained, is discovered as the following equation by least squares method:

$$Y=1063.1 \exp(-0.0822X)\approx 1060 \exp(-0.082X)$$

wherein X is defined as the heating temperature (degrees), and Y is defined as the heating time (seconds).

As the result of the experiments, it is proved that the print medium I is necessarily heated in the first heating step on the condition that the heating time Y is shorter than approximately 1060 exp (−0.082X). This condition corresponds to heating with a small amount of energy, thereby, not causing the color-forming material to transform. In addition, it is discovered that the heating time Y needs to be longer than a second in order to promote the color-forming reaction.

Finding the proper heating condition for the first heating step in FIG. 5, it is considered that the area A in FIG. 5 is appropriate for the first heating step. In other words, when heating the print medium 1 in the condition defined as the area A, the color-forming reaction is promoted without the transformation of the color-forming material, enough to increase in the optical density to the practical value in the second heating step.

Furthermore, it is generalized that the print medium 1 is necessarily heated in the second heating step on the condition that the heating time Y is longer than approximately 1060 exp (−0.082X), since the optical density is raised in a short time by heating the print medium 1 with the large amount of energy (mentioned above). However, overheating is inefficient, at the same time the color-forming material is transformed thereby. It is also discovered that Y=1 is long enough for the second heating step. If the heating time shorter that Y=1, or one second, no effect can be obtained.

Similarly, in finding the proper heating condition for the second heating step, it is considered that the area B in FIG. 5 is appropriate for the second heating. In other words, when heating the print medium 1 in the condition defined as the area B, the optical density is efficiently increased to the practical value in a short time.

Therefore, the optical density of images is raised high enough for practical use by heating the print medium 1 on the condition described above, by the time that the images outputted on the print medium 1 are discharged out of the imaging system. The images of good tonal qualities can reliably be formed in a short time with little increase in the optical density.

In the present embodiment, the print medium 1 is heated in two steps with the first post heater 19 formed of a pair of heating plates, and the second post heater 20 formed of a pair of heating rollers. However, both of the first post heater 19 and the second post heater 20 may be formed of a pair of heating plates, or heating rollers. Further, although two post heaters are used in the present embodiment, three or more post heaters may be used to heat the print medium 1 gradually.

While the invention has been described in detail with reference to the specific embodiment thereof, it would be apparent to those skilled in the art that various changes and modifications may be made therein without departing from the spirit and the scope of the invention.

In conclusion, the imaging system according to the preferred embodiment of the invention, in which more than two post heaters are provided, can form images with good tonal qualities in a short time by heating the print medium 1 step by step, thereby, using the color-forming material efficiently.

What is claimed is:

1. An imaging system that forms a latent image on a photosensitive print medium using microcapsules which encapsulate a color-forming material and change in mechanical strength from exposure to light having a certain wavelength, comprising:

an irradiation unit that selectively emits the light having the certain wavelength to the print medium;

a pressure-development unit that ruptures the microcapsules with pressure based on the latent image so that the encapsulated color-forming material flows out so as to form an image; and a heating unit that heats the printing medium to promote a color-forming reaction, wherein heating performed by the heating unit is performed according to a plurality of heating steps.

2. The imaging system according to claim 1, wherein in a first heating step, the heating unit heats the print medium without the transforming of the color-forming material.

3. The imaging system according to claim 1, wherein in a second heating step, the heating unit heats the print medium at a higher temperature than the heating performed in the first step.

4. The imaging system according to claim 2, wherein the first heating step is executed on the condition that the heating time Y is shorter than approximately 1060 exp (−0.082X) seconds and longer than a second, and X is defined as the heating temperature.

5. The imaging system according to claim 3, wherein the second heating step is executed on the condition that the heating time Y is longer than approximately 1060 exp (−0.082X) seconds, and X is defined as the heating temperature.

6. The imaging system according to claim 5, wherein the heating time Y is shorter than a second.

7. The imaging system according to claim 4, wherein the second heating step is executed on the condition that the heating time Y is longer than approximately 1060 exp (−0.082X) seconds, and X is defined as the heating temperature.

8. The imaging system according to claim 7, wherein the heating time Y is shorter than a second.

9. The imaging system according to claim 1, wherein the heating unit includes at least two post heaters, wherein a first post heater performs the first heating step, and a second post heater performs the second heating step.

10. The imaging system according to claim 9, wherein the first post heater comprises a pair of heating plates, and the second post heater comprises a pair of heating rollers.

11. The imaging system according to claim 1, wherein the plurality of heating steps includes a preliminary heating step and a step for accelerating a color-forming reaction.

12. The imaging system according to claim 1, wherein in a first heating step, the heating unit applies heat to the print medium in the range of between 30°–70° C., and in a second heating step, the heating unit applies heat to the print medium in the range of between 85°–180° C.

13. The imaging system according to claim 1, wherein in a first heating step, the heating unit applies heat to the print medium at approximately 40° C., and in a second heating step, the heating unit applies heat to the print medium at approximately 170° C.

14. A method of forming a latent image on a photosensitive print medium using microcapsules which encapsulate a color-forming material and change in mechanical strength from exposure to light having a certain wavelength, comprising:

selectively emitting the light having the certain wavelength to the print medium;

rupturing the microcapsules with pressure based on the latent image so that the encapsulated color-forming material flows out so as to form an image; and heating the printing medium according to a plurality of heating steps to promote a color-forming reaction.

15. The method according to claim 14, wherein in a first heating step, the heating unit heats the print medium without the transforming of the color-forming material.

16. The method according to claim 14, wherein in a second heating step, the heating unit heats the print medium at a higher temperature than the heating performed in the first step.

17. The method according to claim 15, wherein the first heating step is executed on the condition that the heating time Y is shorter than approximately 1060 exp (−0.082X) seconds and longer than a second, and X is defined as the heating temperature.

18. The method according to claim 16, wherein the second heating step is executed on the condition that the heating time Y is longer than approximately 1060 exp (−0.082X) seconds, and X is defined as the heating temperature.

19. The method according to claim 18, wherein the heating time Y is shorter than a second.

20. The method according to claim 17, wherein the second heating step is executed on the condition that the heating time Y is longer than approximately 1060 exp (−0.082X) seconds, and X is defined as the heating temperature.

21. The method according to claim 17, wherein the heating time Y is shorter than a second.

22. The method according to claim 14, wherein the heating steps are performed using a heating unit that includes at least two post heaters, wherein a first post heater performs the first heating step, and a second post heater performs the second heating step.

23. The method according to claim 22, wherein the first post heater comprises a pair of heating plates, and the second post heater comprises a pair of heating rollers.

24. The method according to claim 14, wherein the plurality of heating steps includes a preliminary heating step and a step for accelerating a color-forming reaction.

25. The method according to claim 14, wherein in a first heating step, heat is applied to the print medium in the range of between 30°–70° C., and in a second heating step, heat is applied to the print medium in the range of between 85°–180° C.

26. The method according to claim 14, wherein in a first heating step, heat is applied to the print medium at approximately 40° C., and in a second heating step, heat is applied to the print medium at approximately 170° C.

* * * * *